United States Patent [19]

Shimizu et al.

[11] 4,222,720

[45] Sep. 16, 1980

[54] CORNER SEAL MEANS FOR ROTARY PISTON ENGINES

[75] Inventors: Kazuma Shimizu; Yoshitaka Nomoto; Shisou Kariyama, all of Hiroshima, Japan

[73] Assignee: Toyo Kogyo Co., Ltd., Hiroshima, Japan

[21] Appl. No.: 935,858

[22] Filed: Aug. 22, 1978

[30] Foreign Application Priority Data

Aug. 24, 1977 [JP] Japan ..... 52/113650[U]

[51] Int. Cl.[3] ..... F01C 19/10

[52] U.S. Cl. ..... 418/121; 418/142

[58] Field of Search ..... 418/120, 121, 142, 152, 418/153

[56] References Cited

U.S. PATENT DOCUMENTS

| | | | |
|---|---|---|---|
| 1,560,624 | 11/1925 | Varley | 418/142 |
| 3,064,880 | 11/1962 | Wankel et al. | 418/142 |
| 3,180,562 | 4/1965 | Bentele | 418/142 |
| 3,211,103 | 10/1965 | Kiekhaefer | 418/153 |
| 3,374,943 | 3/1968 | Cervenka | 418/142 |
| 3,674,384 | 7/1972 | Larrinaga et al. | 418/120 |
| 3,830,600 | 8/1974 | Shimoji et al. | 418/121 |
| 3,890,067 | 6/1975 | Rao et al. | 418/121 |
| 3,961,871 | 6/1976 | Kurio | 418/121 |
| 4,056,338 | 11/1977 | Eiermann | 418/121 |

FOREIGN PATENT DOCUMENTS

| | | | |
|---|---|---|---|
| 50-137405 | 12/1975 | Japan | 418/142 |
| 1324443 | 7/1973 | United Kingdom | 418/152 |

*Primary Examiner*—John J. Vrablik

*Attorney, Agent, or Firm*—Fleit & Jacobson

[57] ABSTRACT

Rotary piston engine having a substantially polygonal rotor provided at each apex portion with an apex seal and corner seals. The corner seal is so arranged that it is forced under the gas pressure introduced in a space behind it toward the side housing. A filler member comprised of a non-rigid material such as a heat resistant rubber or a suitable composite material is provided in a clearance between the corner seal and an adjacent end of the apex seal so as to prevent gas leakage through the clearance.

7 Claims, 5 Drawing Figures

CORNER SEAL MEANS FOR ROTARY PISTON ENGINES

The present invention relates to rotary piston engines and more particularly to corner seals for such rotary piston engines.

Conventional rotary piston engines include a casing comprised of a rotor housing having a trochoidal inner wall surface and a pair of side housings secured to the opposite sides of the rotor housing to define a rotor cavity, and a substantially polygonal rotor disposed in said rotor cavity with apex portions in sliding contact with the inner wall surface of the rotor housing to define working chambers of variable volume between flanks of the rotor and the inner wall of the rotor housing. In this type of rotary piston engine, the rotor is provided at each apex portion with an apex seal which is carried in a groove formed in each apex portion and adapted to engage with the inner wall surface of the rotor housing. The rotor is further provided with side seals at each side surface thereof for sliding engagement with inner surface of each side housing. At each end of the apex seal, the rotor is also provided with a corner seal for providing a gas-tightness at the junction between the end of the apex seal and adjacent ends of side seals.

Conventional corner seal is of a cylindrical configuration and adapted to be positioned in a cylindrical recess provided for the purpose in the rotor. The corner seal is formed with a longitudinally extending groove in which the adjacent end of the apex seal is received.

In this type of sealing arrangement, the apex seals and the side seals are forced into engagement with the cooperating surfaces under the pressure of gas which is introduced into the respective seal grooves and acting on the backsides of the respective seals, so that a satisfactory gas tight seal is provided in these areas. It has been experienced, however, that gas under pressure is allowed to leak through clearances between the outer cylindrical surface of the corner seal and the seal recess in the rotor and between the apex seal and the seal groove in the corner seal because the clearances are communicating through a space provided at the bottom portion of the seal recess for placing a corner seal spring with the clearance between the apex seal and the seal groove in the apex portion of the rotor.

In order to minimize the gas leakage through the clearance between the outer surface of the corner seal and the seal recess in the rotor, a proposal has been made by the U.S. Pat. No. 3,961,871 issued to N. Kurio to provide a thin wall portion in the corner seal so that the corner seal possesses a flexibility in radial direction in such an extent that the outer surface of the corner seal is brought into an intimate contact with the wall surface of the seal recess. However, it has been experienced that even with this proposal it is difficult to perfectly prevent the gas leakage along the outer surface of the corner seal. Further, the proposed arrangement is not effective at all to prevent the gas leakage through the clearance between the apex seal and the seal groove in the corner seal.

Japanese utility model application No. Sho 49-49647 which has been disclosed for public inspection under the disclosure number of No. Sho 50-137405 teaches to use a spring embedded in a resilient foamed material along the backside of each side seal. According to the arrangement, gas leakage along the backside of the side seal can be effectively prevented. However, even if the concept of the utility model is applied to the biasing spring which is adapted to force the corner seal against the inner wall of the side housing, it is impossible to prevent the gas leakage along the corner seal.

It is therefore an object of the present invention to provide means for effectively preventing gas leakage along a corner seal of a rotary piston engine.

Another object of the present invention is to provide means for preventing gas leakage through clearances between apex seals and seal grooves in corner seals of a rotary piston engine.

According to the present invention, the above and other objects can be accomplished by a rotary piston engine comprising a casing which has an inner peripheral wall surface of trochoidal configuration and a pair of opposed inner side wall surfaces, a substantially polygonal rotor disposed in said casing and having apex portions adapted to be slidably engaged with the inner peripheral wall surfaces and opposite side surfaces confronting with the inner side wall surfaces of the casing, said rotor being formed at each apex portion with an axially extending seal groove for receiving the apex seal and at each side surface with a recess located adjacent to each apex portion for receiving a corner seal, said seal groove being continuous with the recess at each end of the seal groove so that gas pressure is introduced through the seal groove into the recess to force the corner seal against the inner side wall surface of the casing, said corner seal having a groove for receiving an adjacent end of the apex seal with a gap therebetween, filler means of non-rigid material disposed in said gap between the groove in the corner seal and the apex seal. Preferably, means is provided for preventing the filler means from being moved out of the groove in the corner seal.

The filler means may be made of a composite material containing 10 to 80 volume percent of fibers of inorganic material such as carbon or asbestos or fibers of metal such as copper or brass and the balance of fluorine contained resin. In a preferable aspect of the present invention, the corner seal is formed with a thin walled portion so as to possess a flexibility in radial direction.

The above and other objects and features of the present invention will become apparent from the following descriptions of preferred embodiments taking reference to the accompanying drawings, in which.

Figure 1:
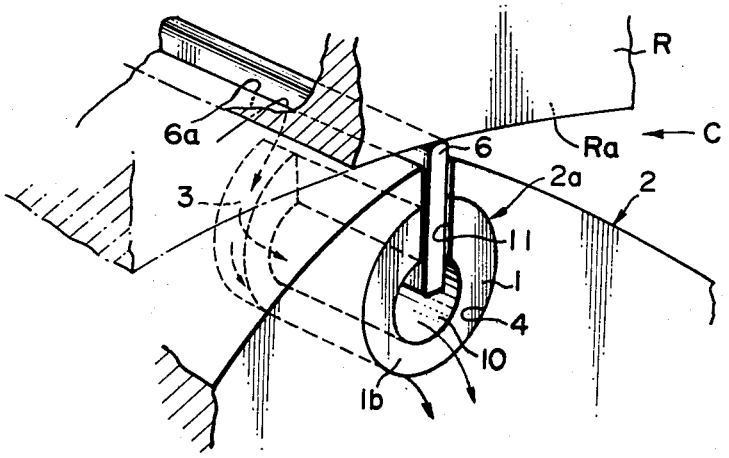
FIG. 1 is a fragmentary perspective view showing a typical example of a seal arrangement for a rotary piston engine to which the concept of the present invention can be applied.
Figure 2:
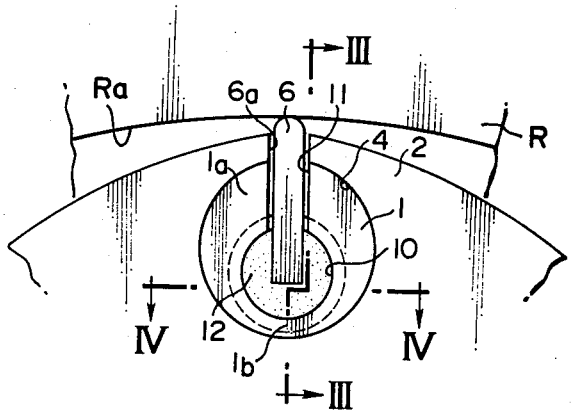
FIG. 2 is a fragmentary side view showing the seal arrangement in accordance with one embodiment of the present invention.
Figure 3:
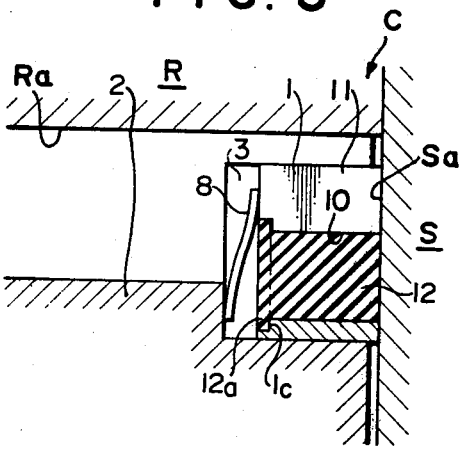
FIG. 3 is a sectional view taken substantially along the line III—III in FIG. 2.

Referring to the drawings, particularly to FIGS. 1 through 3, the rotary piston engine shown therein comprises a casing C which is comprised of a rotor housing R having an inner wall surface Ra of trochoidal configuration, and a pair of side housings S, respectively having inner wall surfaces Sa and secured to the opposite sides of the rotor housing Ra. In FIG. 3, only one of the side housings S is shown.

In the casing C, there is disposed a substantially triangular rotor 2 which has apex portions 2*a*, each being formed with an axially extending apex seal groove 6*a*. The rotor 2 is further formed at the opposite sides of each apex portion 2*a* with cylindrical recesses 4 which communicate with the apex seal groove 6*a*. In the apex seal groove 6*a*, there is inserted an apex seal 6 which is biased by a suitable means such as a spring against the inner wall surface Ra of the rotor housing R for slidable engagement therewith. In the cylindrical recess 4 at each side of each apex portion 2*a*, there is disposed a corner seal 1 which generally has a cylindrical configuration.

The corner seal 1 has a longitudinally extending bore 10 which is offset with respect to the longitudinal axis of the cylinder of the corner seal and a longitudinally extending slit 11 is formed in the corner seal 1 at the side opposite to the direction of offset of the bore 10. As shown in FIGS. 1 and 2, the apex seal 6 is received at each end by the slit 11. As shown in FIG. 3, the corner seal 1 is biased axially outwardly against the inner wall surface Sa of the side housing S by means of a spring 8 which is disposed in a space 3 formed between the bottom of the recess 4 and the axially inner end of the corner seal 1.

In this arrangement, gas pressure in the working chamber is allowed to pass through the apex seal groove 6*a* into the space 3 in the recess 4 as shown by arrows in FIG. 1 so that the corner seal 1 is further forced under the gas pressure against the inner wall surface Sa of the side housing S. The pressurized gas in the space 3 may then be allowed to leak through the bore 10 and the clearance between the slit 11 and the apex seal 6.

In order to prevent such leakage of gas, the axial bore 10 in the corner seal 1 is filled with a filler member 12 which is made of a non-rigid material such as a heat resistant rubber, for example, fluorine containing rubber, Teflon containing rubber or silicon rubber. Alternatively, a composite material containing carbon particles bonded by Teflon may be used. It should however be noted that the filler material is not limited to those referred to above but the only requirements for the filler member are that it possesses a suitable softness so that it does not disturb the resiliency of the corner seal, and that it is adequately resistive to heat and wear. It has been found from the viewpoint of heat and wear resistance as well as anti-swelling and anticreep characteristics that a preferable material for the filler member is a composite material comprised of 10 to 80 volume percent of inorganic fibers such as carbon and asbestos or metal fibers such as copper and brass and the balance of fluorine contained resin.

The configuration of the corner seal having the offset or eccentric axial bore provides the corner seal with thick walled portions 1*a* and a thin walled portion 1*b* so that the corner seal 1 is given with a flexibility and resiliency in radial direction. Therefore, it is possible to design the corner seal so that it engages the wall of the recess 4 uniformly throughout the periphery thereof.

Figure 4:
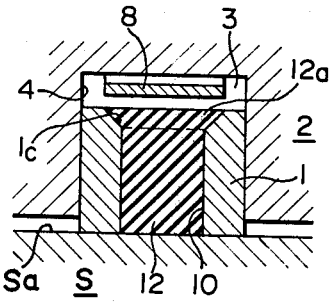
FIG. 4 is a sectional view taken substantially along the line IV—IV in FIG. 2 but showing another embodiment of the present invention.
Figure 5:
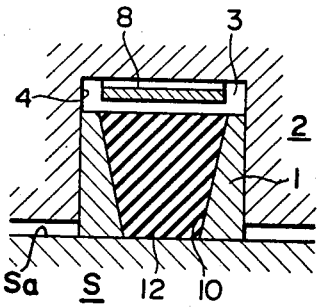
FIG. 5 is a sectional view similar to FIG. 4 but showing a further embodiment of the present invention.

Referring to FIG. 3, it will be noted that the filler member 12 is formed at the axial inner end with a radial enlargement 12*a* which is adapted to engage with a corresponding recess 1*c* formed at the axial inner end of the corner seal 1. The enlargment 12*a* functions to prevent the filler member 12 from being moved axially outwardly with respect to the corner seal 1 under the influence of the gas pressure in the space 3. The radial enlargement 12*a* may be of frusto-conical configuration as shown in FIG. 4. In this instance, the recess 1*c* in the corner seal must of course be of a frusto-conical configuration. Alternatively, as shown in FIG. 5, the axial bore 10 in the corner seal 1 may generally be of a frusto-conical configuration with a diameter decreasing toward the axial outer end of the corner seal 1 and the filler member may have a corresponding frusto-conical configuration. As an alternative arrangement, the corner seal 1 may be provided at the wall surface of the axial bore 10 with one or more projections for preventing the filler member 12 from being moved axially with respect to the corner seal 1.

The arrangement for preventing movement of the filler member with respect to the corner seal is important because without such arrangement the filler member 12 will be forced under the gas pressure in the space 3 against the inner wall surface Sa of the side housing S and rapidly worn and destroyed.

According to the feature of the present invention, the clearance or gap between the corner seal and the apex seal is filled with the filler member of non-rigid material so that gas leakage through the clearance can effectively be eliminated and thus the corner seal positively forced against the inner wall surface of the side housing by the gas pressure prevailing at the back side of the corner seal.

The invention has thus been shown and described with reference to specific embodiments, however, it should be noted that the invention is in no way limited to the details of the illustrated structures but changes and modifications may be made without departing from the scope of the appended claims.

We claim:

1. Rotary piston engine comprising a casing which has an inner peripheral wall surface of trochoidal configuration and a pair of opposed inner side wall surfaces, a substantially polygonal rotor disposed in said casing and having apex portions adapted to be slidably engaged with the inner peripheral wall surfaces and opposite side surfaces confronting with the inner side wall surfaces of the casing, said rotor being formed at each apex portion with an axially extending seal groove for receiving an apex seal and at each side surface with a cylindrical recess located adjacent to each apex portion for receiving a corner seal having a cylindrical outer surface, said seal groove being continuous with the recess at each end of the seal groove, said corner seal having an axially extending bore which is offset in one radial direction with respect to longitudinal axis of the cylindrical outer surface of the corner seal and an axially extending slit which is formed to extend from the bore radially to the outer surface of the corner seal at the side opposite to the direction of the offset of said bore, said bore and slit being adapted for receiving an adjacent end of the apex seal with gaps therebetween, filler means of non-rigid material disposed in said gap between the bore in the corner seal and the apex seal for preventing gas leakage through said last-mentioned gap, and means for restricting movement of the filler means with respect to the corner seal toward the adjacent inner side wall of the casing.

2. Rotary piston engine in accordance with claim 1 in which said restricting means is constituted by a frusto-conical configuration in longitudinal section of the filler means with diameter continuously decreasing toward the end facing to the inner side wall surface of the casing, said corner seal having correspondingly shaped recess means for receiving the filler means.

3. Rotary piston engine in accordance with claim 1 in which said filler means is made of a composite material containing 10 to 80 volume percent of fibers of inorganic material such as carbon or asbestos or fibers of metal such as copper or brass and the balance of fluorine contained resin.

4. Rotary piston engine in accordance with claim 1 in which the filler means is made of a fluorine containing rubber.

5. Rotary piston engine in accordance with claim 1 in which said restricting means is radial enlargement means formed on the filler means at an end opposite the end facing to the inner side wall surface of the casing, said corner seal being formed with recess means at an end opposite to an end facing to the inner side wall surface of the casing for receiving said radial enlargment means.

6. Rotary piston engine in accordance with claim 5 in which said radial enlargement means is in the form of an annular flange.

7. Rotary piston engine in accordance with claim 5 in which said radial enlargement means is in the form of an annular flange having a frusto-conical longitudinal section.

* * * * *